US005389016A

United States Patent [19]

Nestvall

[11] Patent Number: 5,389,016

[45] Date of Patent: Feb. 14, 1995

[54] STEERING SYSTEM FOR PLANING WATERCRAFTS

[75] Inventor: Per Nestvall, Göteborg, Sweden

[73] Assignee: Volvo Penta AB, Sweden

[21] Appl. No.: 50,378

[22] PCT Filed: 11/01/91

[86] PCT No.: PCT/SE91/00739

§371 Date: 12 May 1993

§102 Date: 12 May 1993

[87] PCT Pub. No.: WO92/09475

PCT Pub. Date: 11 June 1992

[30] Foreign Application Priority Data

Nov. 23, 1990 [SE] Sweden ..... 9003727

[51] Int. Cl.[6] ..... B63H 5/12

[52] U.S. Cl. ..... 440/1; 440/61

[58] Field of Search ..... 14/122, 152; 440/1, 440/2, 53, 61

[56] References Cited

U.S. PATENT DOCUMENTS 3,581,696 6/1971 Ilon .
4,318,699 3/1982 Wenstadt et al. .
4,787,867 11/1988 Takeuchi et al. .
4,931,025 6/1990 Torigai et al. ..... 440/61
5,167,546 12/1992 Whipple ..... 440/1

FOREIGN PATENT DOCUMENTS 197494 10/1985 Japan ..... 440/1

*Primary Examiner*—Stephen P. Avila
*Attorney, Agent, or Firm*—Lerner, David, Littenberg, Krumholz & Mentlik

[57] ABSTRACT

An arrangement in a steering and propulsion system for a planing type motorboat. The boat is provided with means for adjusting the trim position. The steering characteristics of the boat are improved by providing the steering mechanism with a sensor for detecting rudder displacement. The sensor is connected to the trim position adjustment means via a microprocessor for recording the degree of steering displacement and is adapted to trim down the bow of the boat in the water when a certain steering displacement is exceeded.

7 Claims, 1 Drawing Sheet

STEERING SYSTEM FOR PLANING WATERCRAFTS

TECHNICAL FIELD

The present invention relates to an arrangement in a steering and propulsion system for a planing type motorboat having an engine and a trimmable drive.

BACKGROUND OF THE INVENTION

Planing motorboats are normally driven at relatively high speeds. The difference in speed compared to sailing boats and other non-planing motorboats is therefore appreciable. Since the steering characteristics for planing boats differ somewhat from conventional boats, inexperienced helmsmen experience difficulties at such high speeds. Near-accidents can have many different causes within the common expression "poor seamanship". It would however be desirable if the steering characteristics of planing motor boats were more similar to those of conventional boats.

When executing a turn with a planing boat, what normally happens, without going too deeply into the hydrodynamic factors which come into play, is the following:

If the rudder is moved to e.g. the right, the bow of the boat does not immediately turn towards the desired direction. The rudder blade, or the propulsion unit in the case where steering and propulsion are integrated, generates a side force to the left. The stern is not however moved immediately out to the left since the boat's inertia provides resistance. During the start of the turning manoeuvre it can be said that the rudder skids in the water. The side forces gradually start to take effect so that the stern is drawn to the left, whereby the longitudinal extension of the boat begins to deviate from the original course. The angular deviation implies that water pressure is exerted on the head of the boat from the side so that the bow and the stern move in different directions, i.e. the turn has now commenced. The effect of this procedure is normally that the boat first moves a little to the left of the original course before the right turn occurs.

It is easy to recognise that two fast moving, planing boats on a direct collision course can meet with problems if avoiding manoeuvres are not initiated in time. These steering problems arise on many planing boats, irrespective of whether they are provided with propeller or waterjet drive, integral or separate rudder and propulsion.

SUMMARY OF THE INVENTION

It is an object of the present invention to provide an arrangement which offers improved steering characteristics on a boat of the planing type.

This is achieved in accordance with the present invention by means of an arrangement in a steering and propulsion system for a planing type motorboat having an engine and a trimmable drive, said arrangement comprising:

a) means for adjusting said trimmable drive to various different trim positions;

b) means including a rudder arrangement for effecting steering of the motorboat;

c) a sensor for detecting displacement of said rudder arrangement, said sensor being connected to said means for adjusting said trimmable drive, and d) a microprocessor for recording the degree of displacement of said rudder arrangement, wherein said microprocessor is adapted to trim down the bow of the boat in the water when a certain steering displacement is exceeded.

This arrangement is applicable to most planing-type boats, irrespective of whether the adjustment means for the trim position is separately located on the boat or integrated with the propulsion unit.

In a preferred embodiment, before a turn is commenced, the motorboat presents a prevailing trim angle which is recorded by the microprocessor, the microprocessor being further adapted to cause the boat to readopt this angle when the displacement of the rudder arrangement returns to a neutral position after execution of the turn.

Advantageously, the microprocessor is also connected to means for recording the speed of the boat to thereby take into account the speed of the boat when effecting trim adjustment during a turn.

The invention also provides for a similar arrangement for motorboats having a combined steering and propulsion unit.

BRIEF DESCRIPTION OF THE DRAWINGS

One embodiment of the invention will be described in greater detail in the following by way of example only and with reference to the annexed drawings, in which FIG. 1 schematically illustrates in a sequence of pictures from left to right how a conventional planing boat normally reacts during a turn.

BEST MODE OF CARRYING OUT THE INVENTION

Figure 1:
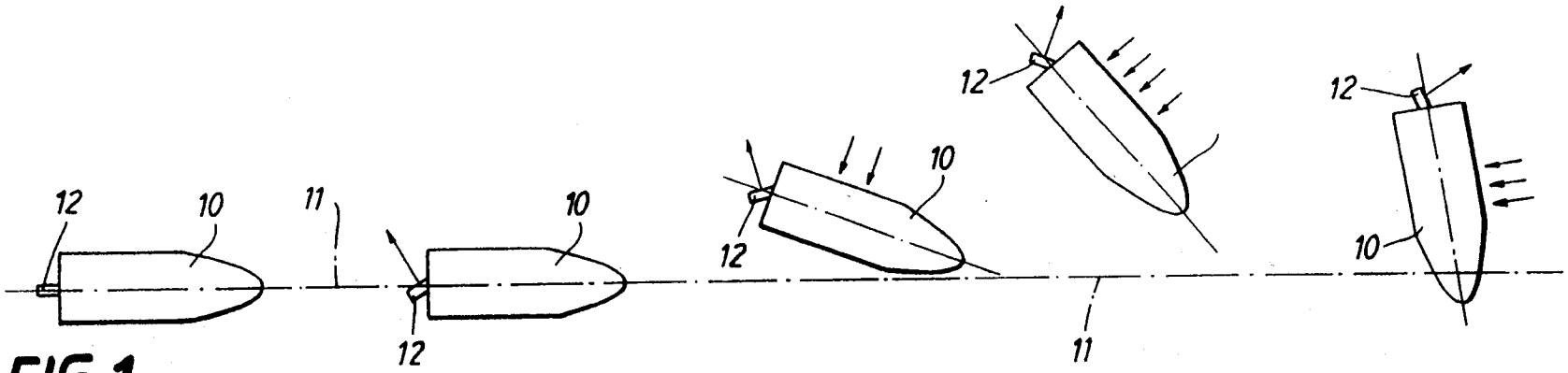

The boat 10 shown in FIG. 1 in a sequence of five pictures moves in the left hand picture along the chain-line 11. In the subsequent picture a turn to the right from the chain-line is initiated by pivoting the propulsion unit 12 of the boat. In the next picture the water pressure begins to act on the hull of the boat, though the boat is now entirely to the left side of the chain-line 11. In the next-to-last picture the water pressure acts with full force on the port side of the boat, but the boat has continued to move in the "wrong direction" with respect to the intended course and is now positioned somewhat to the left of the original course line 11. In the final picture the turn is almost completed and the boat begins to cross the original course line.

The above-described sequence is dependent on the weight of the boat, its speed and the size of the water plane upon which the water can act during the turn. The basic reason why a planing boat displays worse turning characteristics than a conventional boat is that the lateral plane is reduced. It is of course possible to build a boat with such a large lateral plane that it displays good turning characteristics even during planing. The increased wet area does however mean that the power requirement increases and that the fuel economy suffers.

Figure 2:
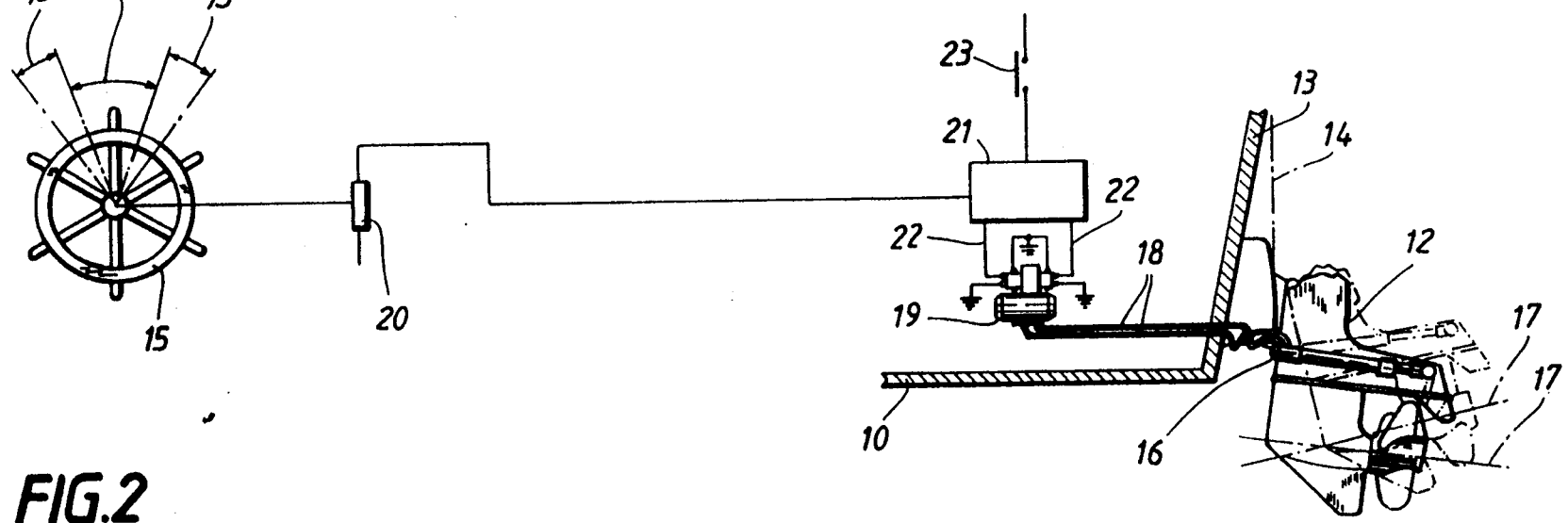
FIG. 2 shows schematically the arrangement according to the invention applied to a so-called aquamatic drive with a trimmable propeller angle.

The invention is shown in FIG. 2 applied to a propulsion unit 12 in the form of a so-called aquamatic drive which is mounted to the stern 13 of the boat and connected to a not shown inboard drive motor.

The drive 12 is arranged in a conventional manner to be pivotable about a substantially vertical axis 14, whereby the drive is maneuvered by a steering arm within the hull, which arm is connected via a wire mechanism to a steering wheel 15 located at the helm of the boat. Neither the steering arm nor the wire mechanism is shown in the drawing since these are well known in this technical field and do not need to be illustrated further.

The trim position of the boat in the water can be adjusted in a conventional manner by pivoting the drive about a substantially horizontal axis by means of a pair of piston cylinders 16. This trim adjustment is normally used to adjust the rotational axis 17 of the propeller so that the boat can accelerate more quickly to its planing position, whereafter the propeller's rotational axis is readjusted to a more energy-saving planing mode.

For the object, the piston cylinders 16 are connected via pipes 18 to a hydraulic motor 19. The hydraulic motor can be operated in a known manner in both directions by means of a control located at the helm.

The invention permits a quicker response to the helm when the boat is to turn during planing from one course to another. This is achieved by providing one of the parts of the boat's steering mechanism, i.e. the wheel, wire mechanism or the drive's steering arm, with a position sensor 20. The sensor is connected to a microprocessor acting as a control center 21, which in turn is connected via leads 22 to the hydraulic motor 19. The center 21 is additionally connected to a power source via a switch 23 which allows the automatic mechanism to be turned off.

The control center 21 is arranged to allow the steering wheel 15 to be turned within a first angular sector $\alpha$, for example for riding waves and small steering corrections, without activating the automatic mechanism. When the wheel 15 is turned through the angular region $\alpha$ and into a second angular region $\beta$, automatic adjustment of the drive 12 occurs so that the rotational axis 17 of the propeller is changed from the optimal planing angle to a position in which the head of the boat is trimmed downwardly somewhat in the water. This increases the wet area and immediately results in improved turning capability. Since the boat has the tendency to dip its bow in the water during the momentary retrimming, this means that precisely at the commencement of the turn a large turning moment is incurred which permits surprisingly quick and sharp turns. In practice, the helmsman senses this as though the planing boat's normal feeling of skidding ceases and that the boat's bow instead "bites" into the water during the turn whilst the stern skids round until the new course is achieved. The result is that the turn can be executed without the boat ending up on the wrong side of the original course line 11.

When the wheel 15 is returned to within the angular range $\alpha$, the original optimal planing trim position is automatically resumed.

The invention is not restricted to the above-described embodiment, but instead many variations are imaginable within the scope of the following claims. For example, the system can be applied to planing boats with outboard motors. In addition, the microprocessor can be connected to a log for recording the speed of the boat so that the trimming effect can be adapted to the boat's speed.

What is claimed is:

1. An arrangement in a steering and propulsion system for a planing type motorboat having an engine and a trimmable drive, said arrangement comprising:

a) means for adjusting said trimmable drive to various different trim positions;

b) means including a rudder arrangement for effecting steering of the motorboat;

c) a sensor for detecting displacement of said rudder arrangement, said sensor being connected to said means for adjusting said trimmable drive, and d) a microprocessor for recording the degree of displacement of said rudder arrangement, wherein said microprocessor is adapted to control said means for adjusting said trimmable drive whereby said trimmable drive is adjusted so as to trim down the bow of the boat in the water when a certain steering displacement is exceeded.

2. Arrangement as claimed in claim 1, wherein before a turn is commenced the motorboat presents a prevailing trim angle which is recorded by the microprocessor, the microprocessor being further adapted to control said means for adjusting said trimmable drive whereby said trimmable drive is further adjusted to cause the boat to readopt this angle when the displacement of the rudder arrangement returns to a neutral position after execution of the turn.

3. Arrangement as claimed in claim 2, wherein the microprocessor is also connected to means for recording the speed of the boat to thereby take into account the speed of the boat when effecting trim adjustment during a turn.

4. Arrangement as claimed in any one of claims 1 to 3, wherein the propulsion system includes a propulsion unit mounted at the stern of the boat.

5. An arrangement in a steering and propulsion system for a planing type motorboat having an engine and a trimmable drive, said arrangement comprising:

a) means for pivoting said trimmable drive about a substantially horizontal axis for adjustment of trim position during planing to various different trim positions;

b) steering means for effecting steering of the motorboat by pivoting said trimmable drive about a substantially vertical axis;

c) a sensor for detecting displacement of said steering means, said sensor being connected to said means for adjusting said trimmable drive, and d) a microprocessor for recording the degree of displacement of said steering means, wherein said microprocessor is adapted to control said means for pivoting said trimmable drive whereby said trimmable drive is pivoted so as to trim down the bow of the boat in the water when a certain steering displacement is exceeded.

6. Arrangement as claimed in claim 5, wherein before a turn is commenced the motorboat presents a prevailing trim angle which is recorded by the microprocessor, the microprocessor being further adapted to control said means for pivoting said trimmable drive whereby said trimmable drive is further pivoted to cause the boat to readopt this angle when displacement of the means for effecting steering of the motorboat returns to a neutral position after execution of the turn.

7. Arrangement as claimed in claim 6, wherein the microprocessor is also connected to means for recording the speed of the boat to thereby take into account the speed of the boat when effecting trim adjustment during a turn.

* * * * *